US006585342B1

(12) United States Patent
Mantell

(10) Patent No.: US 6,585,342 B1
(45) Date of Patent: Jul. 1, 2003

(54) OBJECT ORIENTED IMAGES FORMING

(75) Inventor: David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/711,778

(22) Filed: Nov. 13, 2000

(51) Int. Cl.[7] ..... B41J 29/38
(52) U.S. Cl. ..... 347/14; 347/41
(58) Field of Search ..... 347/43, 15, 14, 347/9, 41

(56) References Cited

U.S. PATENT DOCUMENTS 5,442,385 A 8/1995 Moon et al. ..... 347/43
6,012,792 A * 1/2000 Sievert et al. ..... 347/3
6,016,205 A 1/2000 Silverberg et al. ..... 358/1.6
6,089,697 A * 7/2000 Tajika et al. ..... 347/43
6,164,756 A * 12/2000 Takahashi et al. ..... 347/43
6,302,520 B1 * 10/2001 Akiyama et al. ..... 347/43
6,306,203 B1 * 10/2001 Malhotra et al. ..... 106/31.29

* cited by examiner

*Primary Examiner*—Lamson Nguyen
(74) *Attorney, Agent, or Firm*—Fay, Sharpe, Fagan, Minnich & McKee, LLP

(57) ABSTRACT

A method and apparatus for object oriented image forming is disclosed. An image forming system including a method for printing one or more objects in an image with an image forming device such as a printhead. The method ensures that objects requiring fewer passes are printed with the smaller number of passes. A determination is made by a computing apparatus or processor as to a what is a minimum number of passes of the printhead required to print each object. Then, each object is printed in only the minimum number of passes determined to be required to properly print that object, regardless of how many passes may be required by other objects in a same printing swath.

18 Claims, 6 Drawing Sheets

OBJECT ORIENTED IMAGES FORMING

FIELD OF THE INVENTION

The invention relates to image forming systems, and more particularly relates to image forming systems that print objects in multiple swaths.

BACKGROUND OF THE INVENTION

There are a number of different image forming systems in use today for generating images on a print medium. For example, one of those systems employs focused acoustic energy to eject droplets of marking material, such as ink, from a printhead onto a recording medium. This type of system utilizes printing technology known as acoustic ink printing, (AIP) systems.

Printheads utilized in AIP systems most often include a plurality of droplet ejectors, each of which emits a converging acoustic beam into a pool of fluid (e.g., ink). The angular convergence of this beam is selected such that the beam focuses at or near the free surface of the ink, in other words at the border between the ink and air. Printing is executed by modulating the radiation pressure that the beam of each ejector exerts against the free surface of ink to selectively eject droplets of ink from the free surface.

In the instance where color printing is desired, typically droplets of various different colored inks are ejected from one or more printheads. To achieve the wide variety of colors demanded for documents, differing numbers of droplets of each of the various color inks are positioned together to produce such colors. The most commonly occurring individual colors utilized for the different inks are cyan, magenta, yellow, and black. The colors that may result from differing combinations of the four colors are often identified as the CMYK gamut.

One consistent demand of conventional image forming systems is for image forming devices and systems that operate at greater and greater speeds. The speed at which printed output is produced is primarily a function of the number of passes the printhead is required to make over a particular printing medium. For a printer, the majority of colors can often be printed in a number of passes smaller than the maximum. However, more passes are necessary when any one of the printhead ejectors does not deliver the required ink to a requisite location prior to the printhead moving to a different location on the printing medium.

In many direct marking systems objects such as black text can be printed in a single pass. However, if there is a graphic object or colored text, for example, the printer defaults to multiple pass printing. This can have a significant impact on the visual quality of the black text. Given adequate directionality and ink which does not mottle at volume, that can allow objects other than black text to be printed in a single pass while still maintaining excellent image quality. A significant consideration as to whether to print in a single pass verses a multiple pass is the amount of ink required. While maximum color density is achieved with a full number of ejector droplets (for example, 10 droplets), a solid of 80% of the color reflectance can be printed with only five ejector ink droplets. In other words, a reasonably saturated color with excellent image quality can be achieved in only a single pass. Consequently, there is no need to checkerboard print objects that are within this limited gamut, except for maintaining consistency within the page or from page to page. This is not limited to one and two pass printing. For example, adequate inking and quality for some object might be achieved with two passes, while other objects require more than two passes. An issue arises when trying to exploit this situation. A single object to be printed, which requires only a single pass, may cross the border between two or more swaths. The object in one of the swaths may required only a single pass, and the remainder of the object in the other swath may require more than one pass, i.e., multiple passes. If a portion of the object is printed with a single pass and another portion of the object is printed with multiple passes, there exists the possibility of visual differences at the object boundary. Such visual differences include slight differences in color or texture. The rate at which ink droplets are fired from the printhead and/or the rate at which ink lands on the printing medium may generate these visual differences.

SUMMARY OF THE INVENTION

For the foregoing reasons, there exists in the art a need for an image forming system that takes advantage of possible print modes and preserves the integrity of objects that do not require the maximum number of passes. In general, the present invention provides for a method for printing a plurality of objects in an image with a printhead in an image forming system.

The method begins with the identification, by a computing apparatus or processor, of the objects in the image. The computing apparatus determines the minimum number of passes of the printhead required to print each object in the image. Then, the printhead prints each object in only the minimum number of passes determined to be required to properly print that object. If other objects in the same swath require a different minimum number of passes to be properly printed, they are printed in those minimum number of passes, regardless of the number of passes utilized to print the first object in the swath.

A more economical implementation does not require the identification of objects across swaths. Rather than splitting ink drops equally between passes, the maximum number of drops on one pass and the remainder (if more than the maximum) would be printed on other passes. Thus objects that require fewer drops are printed on a single pass, even if a swath requires multiple passes. If a pass requires no drops of ink, it can be skipped.

As a result, a method of gamut skipping proposes printing some swaths in a single pass and other swaths in multiple passes, the number of passes required per entire swath depends on the number of ink droplets required at each pixel within the swath. A method including these features is disclosed in U.S. application Ser. No. 09/440,424, entitled Choosing Print Passes and Speed Based on Required Number of Drops for Each Swath, filed Nov. 15, 1999, and incorporated herein by reference.

Another way to take advantage of objects that require fewer passes is to print such objects unidirectionally. For example, the object can be printed in one pass within a two pass document. The one pass can always be chosen to be the pass in either the left-to-right or the right-to-left direction.

The term "gamut skipping" as used herein, is intended to include any technique for skipping portions of the substrate or medium or reducing the time to print an image on the substrate. For example, the system can determine the fewest number of passes that are required to produce a desired output for each of the pixels in a particular swath. The term "gamut" as used herein is intended to describe all colors that are achievable by a printing device used in the image forming system. Similar to white-space skipping, another form of printing known to one of ordinary skill in the art, gamut skipping causes the printing device printhead to completely skip any passes that do not require ink to be laid on the printing medium. Gamut skipping is utilized when all pixel colors in the particular swath are within the gamut of earlier passes, and hence have already been achieved by earlier passes. Further, gamut skipping seeks to minimize the number of passes a device printhead makes over each swath.

In accordance with one example embodiment of the present invention, an ink printing system is provided. Such a system includes at least one printhead. In addition, there is a processor in electronic communication with the printhead. The processor receives information regarding a collection of objects to be printed and processes the information to direct a printing pattern such that objects printable in their entirety in a first number of passes are printed in the first number of passes. A remaining portion of the collection of objects is printed in a second, third, or fourth number of passes as required. Hence, the object within the image, rather than the entire image, determines the number of passes required to print the object within each swath.

According to another aspect of the present invention, if a particular object spans between multiple swaths, the number of passes utilized to print the object in the first swath is maintained throughout the printing of the object in the remaining swaths. This consistency is maintained regardless of another object existing in the remaining swaths that is printed in a different number of passes. Such other object is printed in the different number of passes.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

Figure 1:
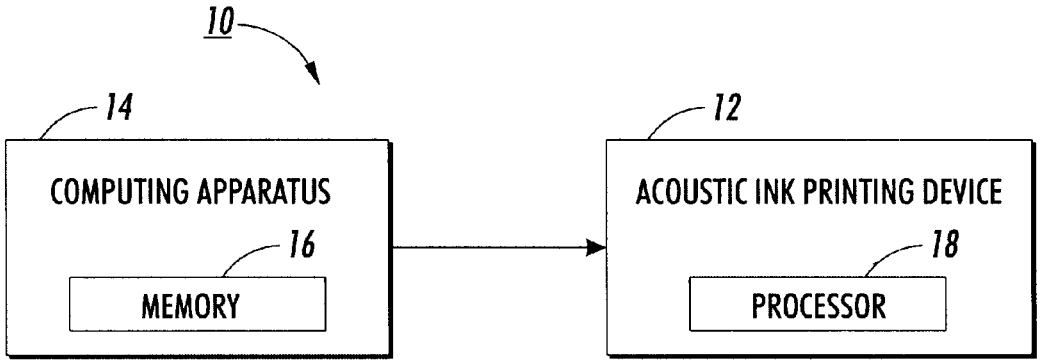
FIG. 1 is a diagrammatic illustration of an acoustic ink printing system according to one aspect of the present invention.

The present invention relates to image forming systems in general. Image forming systems include a collection of different technologies, such as electrophotographic, electrostatic, ionographic, acoustic, inkjet and other types of image forming or reproducing systems that are adapted to capture, and/or store image data associated with a particular object, such as a document, and reproduce, form, or produce an image. For ease of illustration, an acoustic ink printing system will be discussed herein, and is by no means intended to be limited solely to acoustic ink printing.

The method and device of the image forming system analyzes a collection of objects to be printed in a particular swath and determines how many passes are required to print each object in the swath. Objects that are printable in a first number of passes, i.e., one pass, are then printed in only one pass. Objects requiring a second, third, or fourth number of passes are each printed in the minimum required number of passes only. Objects that overlap between two or more swaths are printed in the number of passes determined in the previous swath, regardless of other objects in the swath being printed and their pass number requirements.

Referring now in detail to the drawings wherein like parts are designated by like reference numerals throughout, FIGS. 1 through 7 illustrate an example embodiment of an acoustic ink printing system 10 according to the present invention. Although the present invention will be described with reference to the example embodiments illustrated in the figures, as previously mentioned it should be understood that the present invention can be embodied in many alternative forms. In addition, any suitable size, shape, or type of elements or materials can be utilized.

FIG. 1 illustrates an image forming system in the form of an acoustic ink printing system 10 for printing an image or images. The system includes an acoustic ink printing (AIP) device 12 and a computing apparatus 14. The phrase "computing apparatus" as used herein refers to a programmable device that responds to a specific set of instructions in a well-defined manner and can execute a prerecorded list of instructions. The computing apparatus can include one or more of a storage device, which enables the computing apparatus to store, at least temporarily, data, information, and programs (e.g., RAM or ROM); a mass storage device for substantially permanently storing data, information, and programs (e.g., disk drive or tape drive); an input device through which data and instructions enter the computing apparatus (e.g., keyboard, mouse, or stylus); an output device to display or produce results of computing actions (e.g., display screen, printer, or infrared or digital port); and a central processing unit including a processor for executing the specific set of instructions.

To form an image, the computing apparatus 14 transmits the image data from the memory 16 to the AIP device 12. This transmission can occur via a link 15, such as an electric cable, fiberoptic cable, or other wireless transmission arrangement such as infrared or RF signal. A processor 18 within the AIP device 12 processes the image to be printed.

Figure 2:
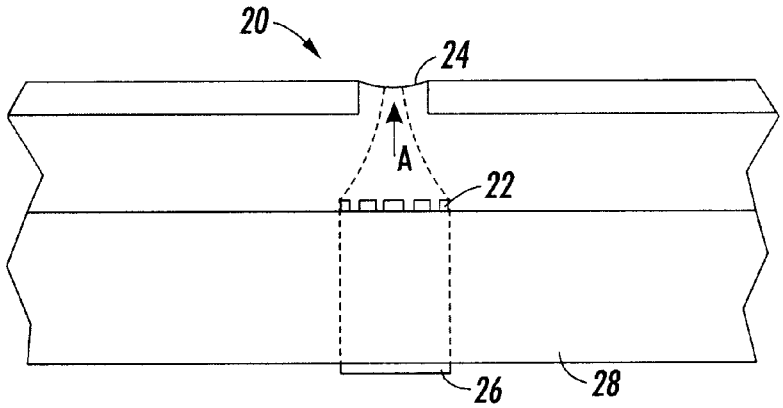
FIG. 2 is a schematic illustration of an acoustic ink printhead according to one aspect of the present invention.
Figure 3:
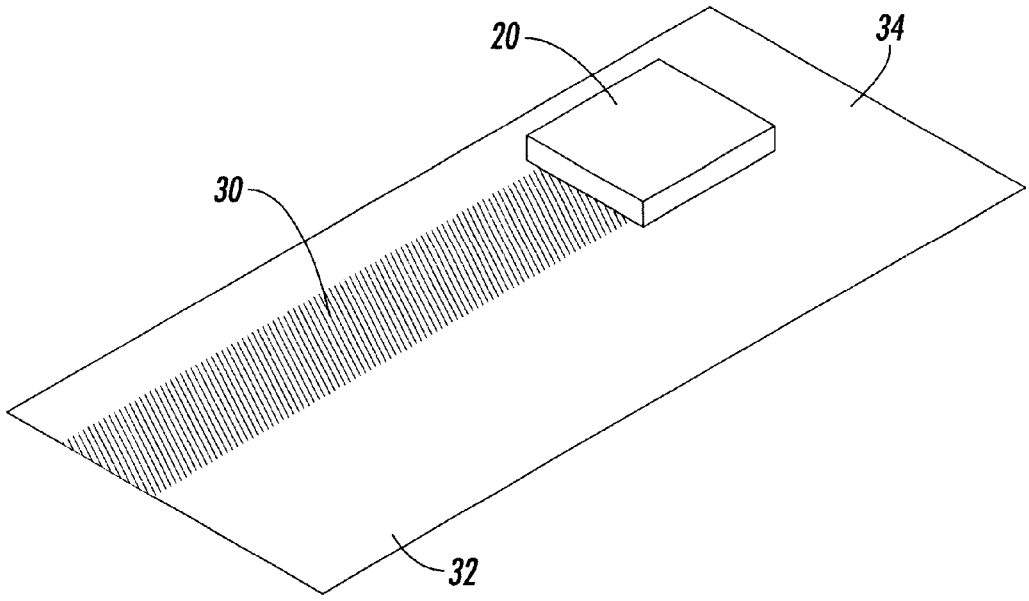
FIG. 3 is a perspective view of acoustic ink printhead over a printing medium according to one aspect of the present invention.

FIG. 2 illustrates a top view of an AIP printhead 20. The AIP printhead 20 includes acoustic generators 22 for ejecting fluid, such as ink, from associated ink ejectors 24. During a printing process, the AIP printhead 20 moves across respective swaths 30 and 32 of the printing medium 34 as illustrated in FIG. 3. The printhead can move across one of the swaths 30 and 32 in one direction, called "one pass", and can return across the same portion of the swath 30 or 32 in a "second pass" or "multi-pass". Passes can extend in number beyond two to most typically three, four, or five passes.

In an example embodiment, each of the swaths 30, 32 is approximately 2 inches in width. The AIP printhead 20 ejects droplets of different colored ink during each pass, producing a wide gamut of colors on the printing medium 34. In one example embodiment, the droplets are less than or equal to approximately two pico-liters. The different colored inks ejected by the AIP printhead 20 can include inks of most typically four different colors, such as cyan, magenta, yellow, and black. Varying numbers of ink droplets of each of the four colored inks are dropped in approximately the same portion of the printing medium to effectively mix and create all colors achievable in the particular gamut such as, the CMYK gamut. Although four different color inks are disclosed herein above, it is anticipated by this disclosure that other numbers and combinations of different colored inks can be utilized to achieve various different color gamuts.

In one aspect of the present invention the AIP printhead 20 passes across the swaths 30 and 32 of the printing medium 34. Ink droplets eject from each ink ejector 24 at relatively high frequency. Approximately up to five ink droplets eject from each ink ejector 24 in a corresponding high resolution pixel on the printing medium 34 during each printhead pass. Therefore up to five ink droplets of each of the four color inks can eject onto a single pixel of the printing medium 34 during each pass.

Prior to printing, the processor 18 identifies the objects that make up an image. Many applications provide images that are already separated into individual objects. In other cases, the object information is lost and the image can be segemented by a computer into different objects. Regardless, there are a number of different image compression technologies available that are compatible with the teachings of the present invention.

During such segmentation, the processor determines whether the printer can print each object in the image in one pass or in multiple passes. For example, if a particular object requires five ink droplets or less, then it is an object printable in a single pass, i.e., a single pass object. Once single pass objects have been identified it is possible to further determine if a particular object in either swath 30 or 32, or in portions of a swath 30 or 32, can be printed in a single pass. Objects that cannot be printed in five ink droplets or less require two or more passes depending, at least in part, on the number of ink droplets required for complete printing. Such objects are multi-pass objects printed in the required number of multiple passes.

The computing apparatus 14 can store image data separately for each pass during rendering. This tends to increase the amount of data stored relative to simply storing a number of ink droplets required per pixel. However, this decreases the data rate and computation required at the later step of conveying the image data to the AIP printhead 20. Further, the computing apparatus saves only one pass for single path swaths. For multi-pass swaths, each pass printed frees an additional portion of memory.

Figure 4:
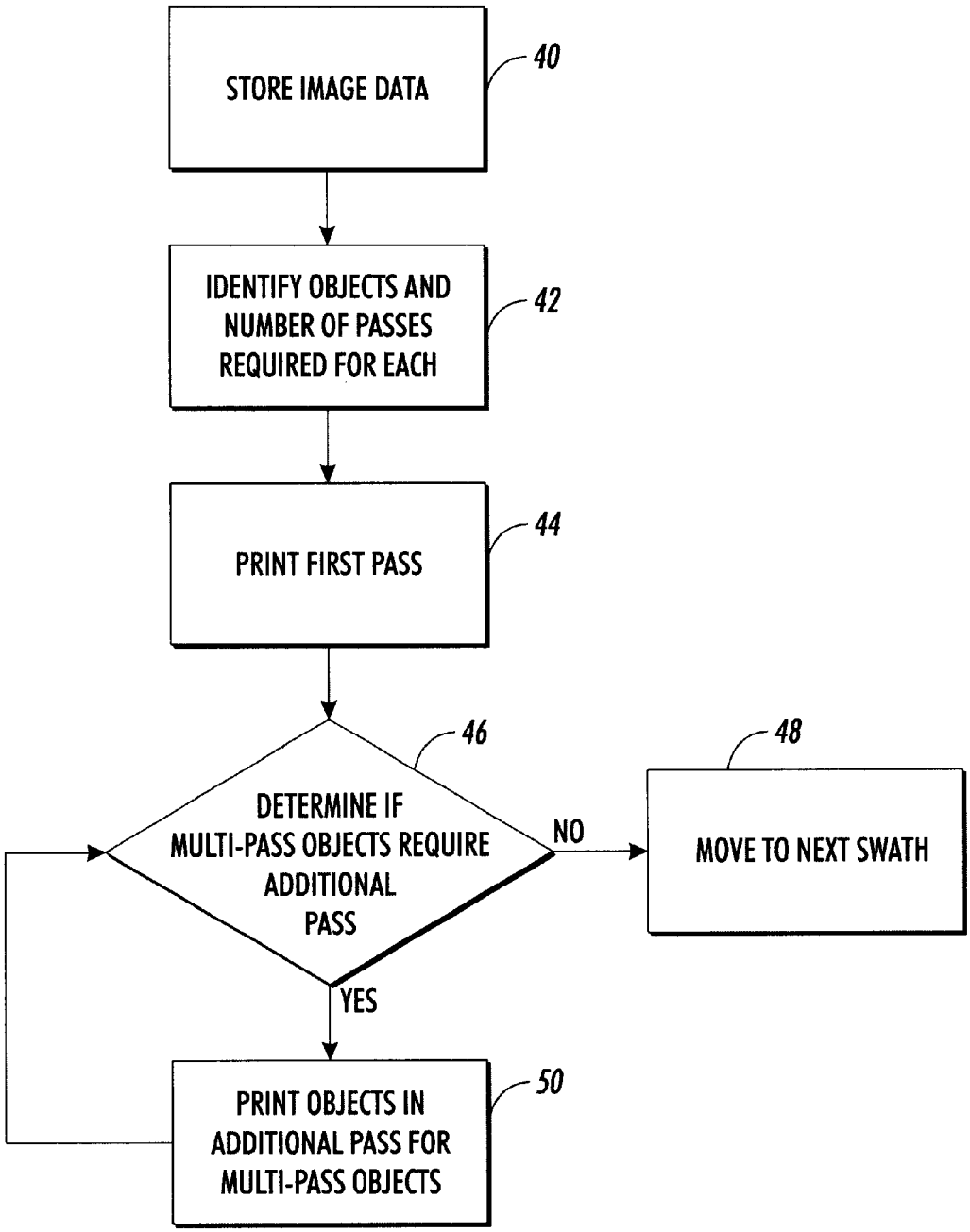
FIG. 4 is a flow chart illustrating a method of acoustic ink printing according to one aspect of the present invention.
Figure 5:
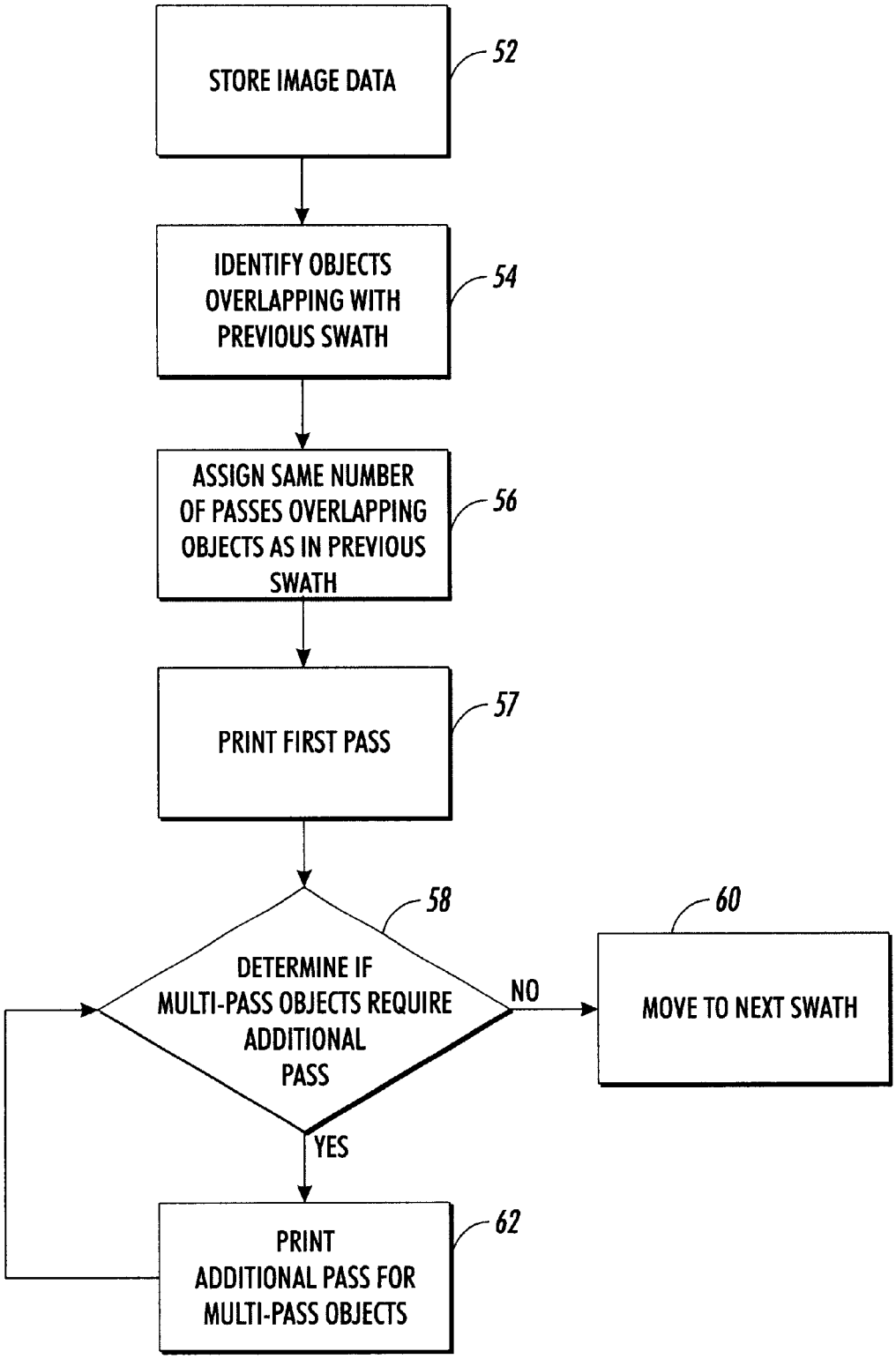
FIG. 5 is a flow chart illustrating a method of acoustic ink printing according to another aspect of the present invention.
Figure 6:
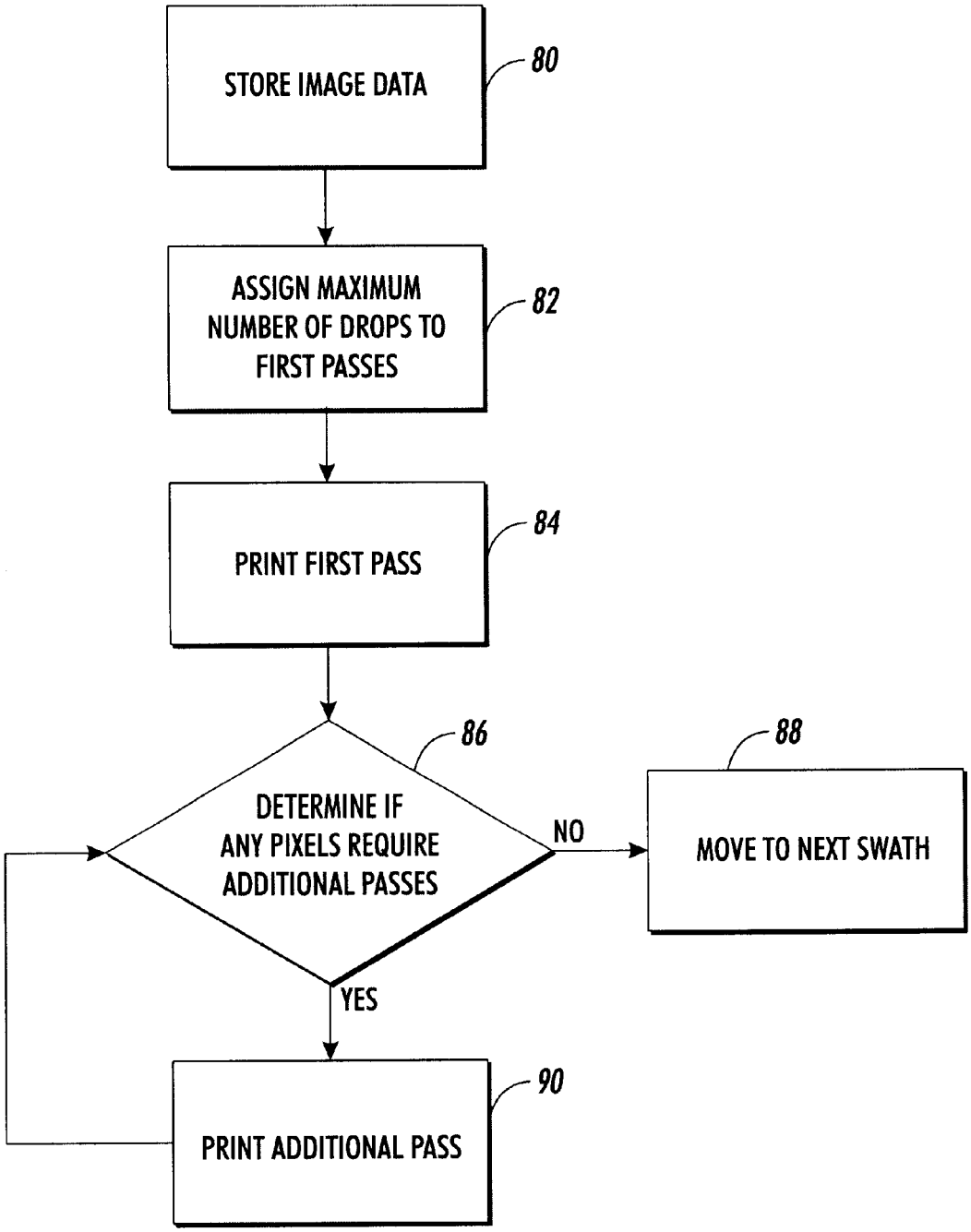
FIG. 6 is a flow chart illustrating a method of acoustic ink printing according to yet another aspect of the present invention.

FIGS. 4, 5, and 6 illustrate aspects of the present invention according to the flowcharts shown. First, as shown in FIG. 4, the computing apparatus stores image data pertaining to a particular image comprised of objects to be printed (step 40). The computing apparatus identifies objects within the image and determines for each individual object how many passes are necessary to print the object (step 42). The ink printing system 10 prints a first pass in a particular swath (step 44). Specifically, the system 10 prints each single pass object in a single pass regardless of the presence of any multi-pass objects. The computing apparatus then determines whether there are any multi-pass objects remaining in the swath that require additional passes (step 46). If there are no more passes required for any particular object in the swath, the AIP printhead 20 advances to the next swath (step 48). Otherwise, the passes repeat as required to complete each object requiring additional passes until completed (step 50).

A second flowchart, shown in FIG. 5, illustrates another aspect of the present invention. In this example embodiment, the computing apparatus 14 of the ink printing system 10 stores image data pertaining to a particular image comprised of objects to be printed (step 52). The computing apparatus identifies objects within the image and determinates for each individual object whether each object overlaps with a previously printed swath. If the object overlaps multiple adjacent swaths, the computing apparatus determines the number of passes utilized in printing each object in the previous swath (step 54). For those objects that overlap with a previous swath, the system 10 prints the object in the same number of passes required to print the objects in the previous swath (step 56). The system 10 then prints the portion of the object in a first pass in a particular swath (step 57). The computing apparatus then determines whether there are any multi-pass objects remaining in the swath that require additional printhead passes (step 58). If there are no more passes required to print any particular object in the swath, the system 10 advances the printhead to the next swath (step 60). Otherwise, the objects are printed in the appropriate number of passes for each object as required to complete the print job (step 62).

A third flowchart is illustrated in FIG. 6. The computing apparatus stores image data pertaining to a particular image comprised of objects to be printed (step 80). The computing apparatus identifies objects within the image and assigns a maximum number of drops to first pass(es) (step 82). The ink printing system 10 prints a first pass in a particular swath (step 84). Specifically, the system 10 prints each single pass object in a single pass regardless of the presence of any multi-pass objects. The computing apparatus then determines if any pixels require additional passes (step 86). If there are no more passes required for any particular pixel in the swath, the AIP printhead 20 advances to the next swath (step 88). Otherwise, the passes repeat as required to print additional passes until completed (step 90).

Figure 7:
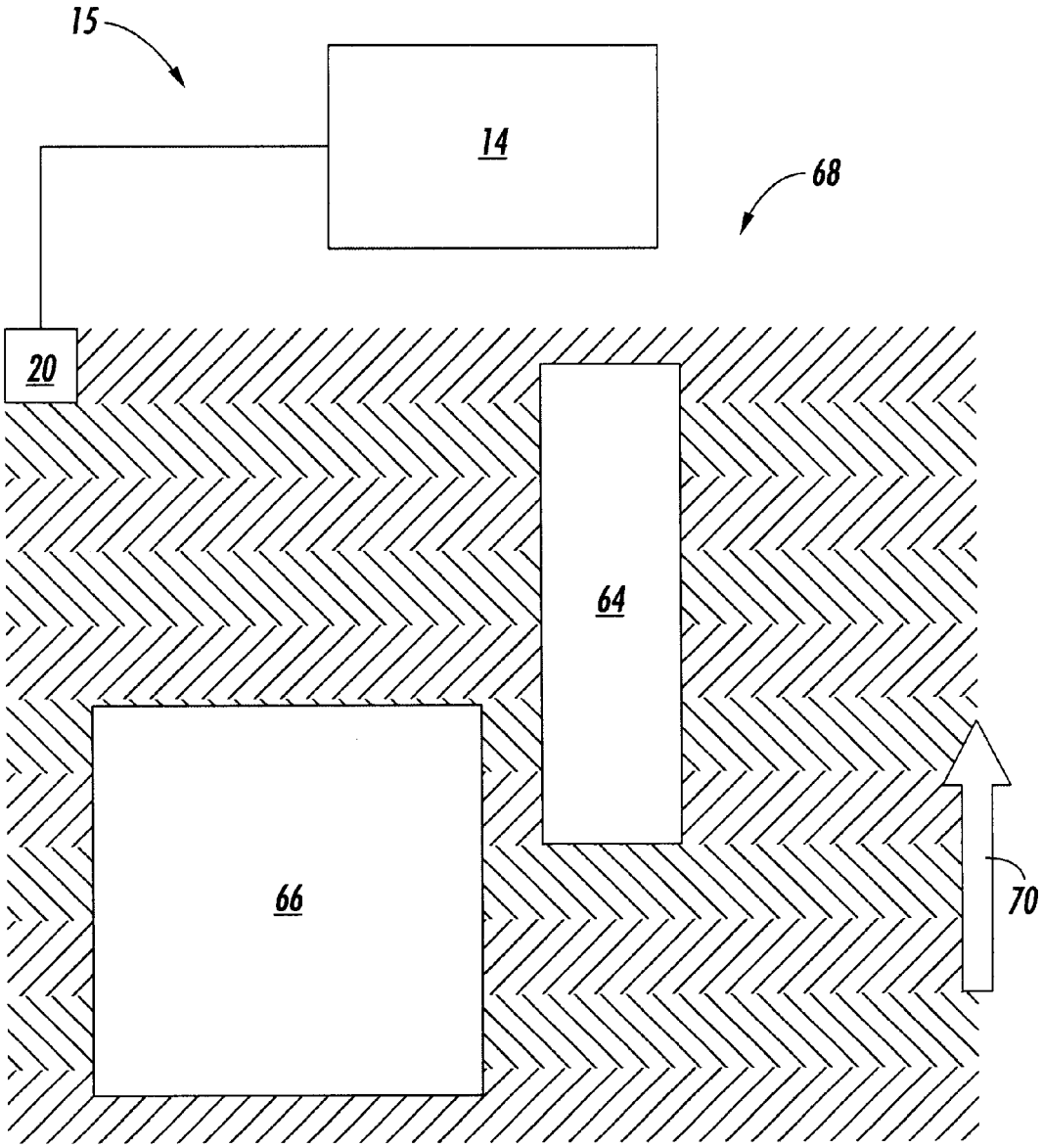
FIG. 7 is an illustration of a printed sheet with two objects resulting from an application of the present invention.

With reference to FIG. 7, a specific example of a print job is illustrated. In this example, two objects print on a printed sheet 68. One object is a single pass object 64. The other object is a multi-pass object 66. The single pass object takes only one pass of the printhead 20 for each swath A through G. The multi-pass object 66 requires two passes for each swath F through K to be properly printed. Swaths A through K do not actually print as shown, but rather, the alternating shading is merely for illustrative purposes only to differentiate between swaths in this example explanation.

The particular printing system illustrated in FIG. 7 does not include partial printhead advances. Such advances are compatible with gamut skipping. For example, in the one pass versus two pass case, when all drops in a previous swath are completed, the printer executes a full printhead advance. If there are still drops to be printed in the lower half of the previous swath, only a half-printhead advance executes.

In one example operation of the present invention, the acoustic ink printing system 10 prints the image having multiple objects 64 and 66. The computing apparatus 14 identifies and analyzes the object 64 and determines that the object 64 is a single pass object. The printhead 20 is shown in a starting position, and is in electronic communication with the computing apparatus 14 through link 15. The printhead 20 size is merely illustrative and those of ordinary skill in the art will recognize that the size and shape can vary.

The computing apparatus 14 instructs the printhead 20 to travel along swath A of the printed sheet 68, in this case left to right, ejecting ink at the appropriate locations to form a top portion of the image, which contains the single pass object 64. Upon reaching an end of swath A, the computing apparatus 14 then determines whether there exists any object in need of any additional passes (e.g., multi-pass objects). In this instance there is not, so the printed sheet 68 advances in a feed direction as illustrated by arrow 72. The printhead 20 is then instructed to travel along swath B, from right to left, ejecting ink at the appropriate locations to form single pass object 64. The process repeats down the page until the printhead reaches swath F.

The computing apparatus 14 identifies two objects in swath F. There is the single pass object 64, and the multi-pass object 66. The printhead 20 rests on the right hand side of the printed sheet 68. The multi-pass object 66 is a two pass object. The computing apparatus 14 instructs the printhead 20 to print a first pass. In that first pass, the printhead 20 prints that portion of the single pass object 64 that is in the swath F. The printhead 20 then proceeds to the multi-pass object 66 and prints the portion of the object 66 that is in swath F in a first pass. The printhead 20 then reaches the left side of the printed sheet 68. At this point, the computing apparatus 14 moves the printhead 20 from left to right to print the remainder of object 66 in a second pass. Upon completing the second pass of multi-pass object 66, the computing apparatus 14 checks and determines that it has already printed the only pass required for single pass object 64, thus the computing apparatus 14 stops the printhead 20 from continuing to print along the pass. The computing apparatus 14 then checks and determines that it has already printed the only two passes required for the multi-pass object 66. The computing apparatus 14 then advances the printed sheet 68. This process and outcome repeats for the only other swath where the single pass object 64 and the multi-pass object overlap, swath G.

Upon completing swath G, all that requires printing are the portions of the multi-pass object 66 in swaths H through K. Accordingly, the computing apparatus 14 instructs the printhead to print two passes across each swath H through K, completing the multi-pass object.

According to another aspect of the present invention, the order by which the ink printing system 10 prints objects in a particular swath varies slightly. In the previously described embodiment, the system 10 prints the single pass objects on the first of two or more passes if there are co-existing multi-pass objects in a particular swath. In another embodiment, the system 10 prints a single pass object on the first pass if part of the object spans a previously printed adjacent swath. If the single object does not span a previously printed adjacent swath, then the system 10 prints the object on a second pass. An object spanning two double pass swaths, and appearing at an edge of the image could then be skipped on non-printing passes. This creates opportunities for greater printing efficiency.

The present invention includes many new features and advantages. The minimum number of passes required for each object is determined. The passes executed in printing each particular object in each swath are based on the specific object characteristics, not on the other objects in the swath, or on the entire image. This prevents the occurrence of one object being printed partially with, e.g., one pass, and partially with e.g., two passes, when the object can be printed in a reduced number of passes. By avoiding unnecessarily segmenting the printing passes, continuity is maintained for each object and printing discrepancies such as printing artifacts or differing print quality and density are greatly reduced. In addition, if an object can be printed in a minimum number of passes, the object is printed in that minimum number of passes. There is no default of multiple passes for a particular swath simply because one or more object in that swath requires a higher number of passes. The present invention provides for printing a single pass object in a single pass, notwithstanding the presence of multi-pass objects in the swath. The present invention also provides for printing an object that spans multiple swaths in the same number of passes, regardless of other objects in each swath. Memory storage efficiencies are attained, as well as some ability to increase speed by not completing multiple passes over objects already printed with a lesser number of passes.

Numerous modifications and alternative embodiments of the invention will be apparent to those skilled in the art in view of the foregoing description. While this description has focused on varying number of passes between objects, there are numerous other printing variations that can be distinguished between different objects such as drop volume, dryer intensity, printing directions, and checkerboarding schemes that are easily adapted to this methodology. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. In an image forming system, a method for printing one or more objects in an image with a printhead, said method comprising the steps of:

identifying said one or more objects in said image;

based on each of said one or more objects determining a minimum number of passes of said printhead required to print each of said one or more objects in said image; and printing each of said one or more objects in only said minimum number of passes.

2. The method according to claim 1, wherein said step of printing further comprises the step of printing said image in a plurality of swaths.

3. The method according to claim 2, wherein within each of a plurality of swaths, said step of printing further comprises the step of printing one of said one or more objects in a first number of passes and at least a second object in a second number of passes.

4. The method according to claim 2, wherein within each of a plurality of swaths, said step of printing further comprises the steps of printing one of said one or more objects in one pass and at least one remaining object in more than one pass.

5. The method according to claim 2, wherein said object spans between first and second adjacent swaths, further comprising the steps of printing said object in said first swath in a predetermined first number of passes, and printing said object in said second swath in said first number of passes.

6. The method according to claim 2, further comprising the step of printing said one or more objects spanning between said plurality of swaths in a same number of printhead passes in each swath.

7. The method according to claim 1, wherein within each of a plurality of swaths, said step of printing each of said one or more objects further comprises the step of printing each of a predetermined number of said one or more objects only in a predetermined minimum number of passes of said printhead.

8. The method according to claim 1, wherein if one of said one or more objects spans multiple previous swaths, said printing step comprising the steps of printing said object in one swath in the same number of printhead passes as determined in a previous swath.

9. The method according to claim 1, wherein if one of said one or more objects spans a previously printed swath, printing said object in a first pass, and if said object does not overlap said previously printed swath, printing said object in a second pass.

10. A method for printing an object in an image with a printhead in an image forming system, said method comprising the steps of:

identifying one or more objects in said image printed, wherein said one or more objects spans between multiple swaths; and printing said one or more objects spanning between said multiple swaths in a same number of printhead passes in each of said multiple swaths.

11. An image forming system, comprising:

at least one printhead; and a processor in electronic communication with said printhead, said processor adapted for receiving information regarding one or more objects in an image to be printed with said printhead, and adapted for processing said information to direct a printing pattern based on said objects in said image to print said objects in their entirety in a minimum number of passes of said printhead required for each of said objects, wherein each object is printed in a minimum number of passes for said object for an entirety of said object.

12. The image forming system of claim 11, wherein said printhead is an acoustic printhead.

13. The image forming system of claim 11, wherein said printhead further comprises an acoustic generator.

14. The image forming system of claim 11, wherein said processor is a computing apparatus.

15. The image forming system of claim 11, wherein said image is printed in multiple swaths and said object spans between first and second swaths, wherein said processor prints a portion of said object in a first swath in a first number of printhead passes, and prints a portion of said object in said second swath in said first number of printhead passes as determined in a previous swath by said processor.

16. In an image forming system, a method for printing one or more objects in an image with a printhead, said method comprising the steps of:

identifying said one or more objects in said image;

based on each of said one or more objects determining a print mode in which to print each object; and printing each of said one or more objects in said print mode appropriate to each of said one or more objects.

17. The method of claim 16, said step of determining a print mode includes a determination of a direction in which a majority of drops are printed.

18. An image forming system, comprising:

at least one printhead; and a processor in electronic communication with said printhead, said processor adapted for receiving information regarding one or more objects in an image to be printed with said printhead, printing a maximum number drops on a first number of passes, such that objects requiring fewer than said maximum number of drops are completely printed on said first number of passes while objects requiring an amount of drops exceeding said maximum number of drops are printed in an additional number of passes, and skipping swaths requiring no drops.

* * * * *